US005377910A

United States Patent [19]

Newton

[11] Patent Number: 5,377,910

[45] Date of Patent: Jan. 3, 1995

[54] RAILROAD SYSTEM

[76] Inventor: Alan R. Newton, 67 Bluebird Ave., East Wareham, Mass. 02538

[21] Appl. No.: 19,288

[22] Filed: Feb. 18, 1993

[51] Int. Cl.[6] ..... F01B 11/34; B61F 9/00

[52] U.S. Cl. ..... 238/121; 238/218; 104/243

[58] Field of Search ..... 104/242, 243; 105/96, 105/215.1; 238/121, 151, 169, 218, 221, 222, 223, 225, 230, 231, 232

[56] References Cited

U.S. PATENT DOCUMENTS

| | | | |
|---|---|---|---|
| 210,705 | 12/1878 | Neff | 238/218 |
| 388,743 | 8/1888 | Thompson | 104/243 |
| 485,286 | 11/1892 | Loyd | 105/215.1 |
| 568,059 | 9/1896 | Wesemann | 104/243 |
| 577,268 | 2/1897 | Parker | 104/243 X |
| 675,645 | 6/1901 | Wood | 238/225 |
| 750,736 | 1/1904 | Urbanitzky | 238/218 X |
| 955,382 | 4/1910 | Clark | 104/243 |
| 972,148 | 10/1910 | Bacon et al. | 238/218 X |
| 1,004,067 | 9/1911 | Papendry | 238/218 |
| 1,041,403 | 10/1912 | Bacon et al. | 238/225 X |
| 1,378,425 | 5/1921 | Rosebrook | 238/218 X |
| 3,732,828 | 5/1973 | Wanner | 104/243 X |
| 3,797,401 | 3/1974 | Alimanestianu | 105/215.1 X |
| 3,902,433 | 9/1975 | Borchert et al. | 104/243 X |
| 5,090,618 | 2/1992 | Newton | 238/218 |
| 5,226,367 | 7/1993 | McLaughlin | 104/243 X |

FOREIGN PATENT DOCUMENTS

| | | | |
|---|---|---|---|
| 2115481 | 10/1972 | Germany | 104/243 |
| 0106770 | 4/1989 | Japan | 104/243 |
| 0000143 | of 1882 | United Kingdom | 104/243 |
| 0002737 | of 1883 | United Kingdom | 105/215.1 |
| 0002669 | of 1911 | United Kingdom | 238/169 |

*Primary Examiner*—Frank E. Werner
*Assistant Examiner*—Scott L. Lowe
*Attorney, Agent, or Firm*—James A. Geppert

[57] ABSTRACT

A double-gauge rail system for the rolling stock of railroad trains including pairs of rails of differing gauges, with the rail track sections of each gauge being in axial alignment but separate and not welded together at the section ends. The inner and outer rail sections of the two gauges at least partially overlap so that the inner rail sections extend across the gaps of the outer rail sections and, likewise, the outer rail sections extend across the gaps of the inner rail sections. To provide continuous contact between the wheels and rails sections, each axle of a vehicle car or engine has pairs of wheels on each end of the axle; the outer pair of wheels corresponding to the outer gauge and the inner pair of wheels corresponding to the inner gauge, so that the wheels of at least one rail gauge are in contact with the corresponding pair of rail sections. Also comprehended by this invention is a "Z" bar connector joining the overlapping ends of the inner and outer rail sections to provide a truss-type arrangement for the rails.

15 Claims, 2 Drawing Sheets

RAILROAD SYSTEM

TECHNICAL FIELD

The invention disclosed herein relates to an improved rail system for laying railroad track and the wheel system for the engines and cars that roll on such track.

BACKGROUND

A significant problem in the construction of rail systems for railroads is in the joining of individual rail sections to form the track. Previous systems utilize standard thirty-nine foot rail lengths assembled together in linear alignment where the rails have slight gaps therebetween providing for thermal expansion and contraction thereof and are joined by pairs of splice plates bolted through the sides of the rail webs and resting upon base plates; the webs having longitudinal slots receiving the bolts to allow for displacement of the rails relative to their length due to such thermal expansion and contraction. The joined rail unit is secured to a crosstie between the rail and the ground using a set of spikes driven through the base plates into the ties with an upper end or head contacting the edge of a spike base to hold the rail flush against an aligning spike plate disposed between the rail base and the tie surface.

More modern practices of installing railroad track is to utilize extended rail lengths instead of the standard thirty-nine foot lengths. The butt ends of the rail sections are 100% welded together and the "ball" or top cross section of the joined rails is ground flush to preserve the original rail profile and thereby assure smooth and continuous running of the wheels of the engines and railroad cars without interference by any joint imperfections. The welds joining the rail sections together cost approximately $80.00 or more for each weld; and before actual welding takes place, the rail sections must be heated to above the anticipated maximum temperature which will eventually happen naturally due to the combination of strong sun and ambient temperature. The sum of all welds and rail sections serves to equal a continuous, single piece of track which is designed to be under unending, permanent tension.

It appears that the combination of friction and a suitable type of anchoring at the track junctions or "turnouts" must prevent shrinkage in cold weather; otherwise the gapping between the rail lengths would become intolerable when the wheels had to pass over the gaps of the rails ends of such junctions. This arrangement involves a substantial investment in special welding equipment.

Dynamics of railroad stock running over the rails include "side sway" which results from imperfections in the parallelism of the tracks. When the track is laid, imperfections are present in both parallelism and level coordination and, to overcome this, the wheels are shaded with a conical diameter blending with a radiused fillet extending into a radial flange. The radius has a dynamic "climb" aspect so the wheel has to climb when swaying against the inside of the rail on that side of the tracks. The resulting rise of the climbing aspect causes the wheel, and the vehicle/car, back toward the center of the tracks. The shift continues until the opposite wheel sends it back, like a pendulum. The conical aspect of the wheel causes a general attitude of allowing the overall mass to find the lowest point to accommodate the center of gravity. Motion of the train generates the energy causing the side shift.

Since the center of gravity of the train is shifted by the combination of track imperfections, the train cars/-wheels are unceasingly and chaotically seeking the lowest center of gravity. One result of this shift or sway is the side load exerted against the "ball" or top of the rail which bends the track outwardly. Special tools are made ant required for the straightening of the rails to the original track specifications, which are still imperfect. Sometimes the rail bend is so extensive, combined with wear and brinnelling, that such sections of track have to be replaced. To replace a section of welded track requires cutting out that section and fitting in a new matching piece, welding the two resulting joints and grinding to "smooth form". This section apparently must also be heated to fill the gap and also compensate for the "tension shrink" of the now loose two ends.

Another problem which is found overseas on the continent is differences in the rail gauges of different countries. Thus, when crossing the border between Spain and France, riders previously had to leave one train and get on another. To overcome that problem, a device was designed which shifts wheels from one gauge to another as the train moves. This device takes the weight off the wheels, pulls down on wheel-locking pins, exerts pressure to move the wheels sideways, and finally locks the pins at the new gauge.

A particular problem associated with the gaps between the rail sections is the considerable loss of ride smoothness. This smoothness of ride is critical in very high speed train applications, and may be a significant concern in passenger transport, especially in the case of bullet trains in Japan and currently under consideration in the United States and other countries. The present invention overcomes this problem and enhances the ride smoothness of the train.

DISCLOSURE OF THE INVENTION

The present invention involves the simultaneous use of two gauges of track which at least partially overlap, but are not necessarily laid for the full length each rail section. The object of a double-gauge rail system is to allow continuous, gapless running on the rails without the necessity of welding or otherwise joining the rail sections together; the rail ends of inner and outer gauges being longitudinally overlapped to provide a continuous transition. The wheels of the engines and cars are in spaced pairs on each end of a single axle in a double-gauge configuration so that either the inner or outer gauge wheel is in contact with its corresponding track. At times, perhaps, both gauge wheels may touch their rails simultaneously. Since the wheel diameters provide a slope-like transition surface, the imperfect alignments are smoothly shifted to their design parameters of alignment. The cost of adding an extra two wheels per axle is estimated to be in the range of $3000.00 for each car manufactured. For the mining-type engines with planetary drive, it is relatively simple to add an extra set of wheels, and existing engines can be easily converted. Braking of the pairs of wheels may also be a problem, however, a simple solution involves using the existing vehicle brakes and joining the inner and outer wheels of a pair together by a) bolting through spaced bushings evenly displaced around the wheel faces or b) a single tubular ring secured between the wheels.

The advantage of double-gauging is that the rails can free-float within constricted Limits or with one end of each rail section welded to a foundation plate and the opposite section end resting on a plate as a bearing/support. If the rails are free floating at both ends, a raised feature or protrusion on the foundation plates will act as a length stop for the ends of each rail. Where side sway is recognized as unusually severe due to topography, the extra parallel rail can be added and bolted through "Z" bar connectors or bushings to provide better than double rail bend resistance since this is a truss-type arrangement. Such truss usage will greatly reduce sway induced bending and hence greater economy in maintenance. Where "frogs" are now used in turn-outs and cross-overs, they will be easily replaced with standard cut rail sections since the "two-wheel per side" configuration provides continuous rolling support on either one wheel or its companion.

MODES FOR CARRYING OUT THE INVENTION

Figure 1:
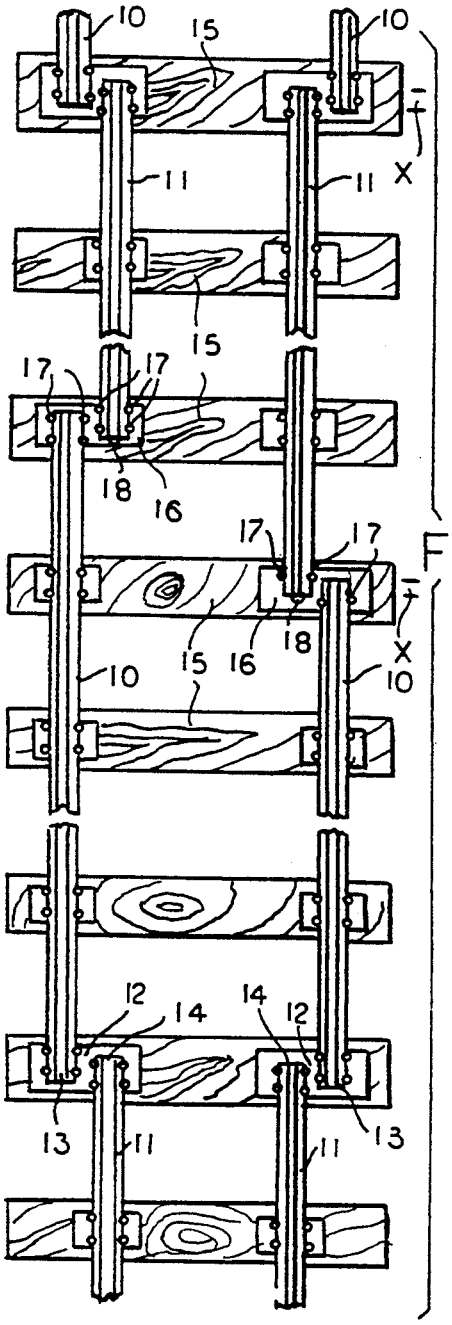
FIG. 1 is a top plan view of a portion of railroad track utilizing the improved double-gauge arrangement of the present invention.

Referring more particularly to the disclosure in the drawings wherein are shown illustrative embodiments of the present invention, FIG. 1 discloses a double-gauge arrangement of the present invention for a railroad track wherein pairs of outer rails 10,10 and inner rails 11,11 are shown in longitudinal overlapping arrangement with lateral spacing 12 between the ends 3,13 of the outer rails and ends 14,14 of the inner rails. In continuation of the small portion of track shown in FIG. 1, the pairs of rails extend in a staggered relationship inwardly and outwardly from the track central region in an alternating fashion. The ends of the inner and outer track sections are overlapped by a distance "x". Each rail section is conventionally joined to the plurality of spaced crossties 15 at spaced intervals by joining base plates 16 which overlap both rail ends 13 and 14 and have spike holes receiving spikes 17 extending through the holes and into the ties 15 to retain the rails in place but allow limited free-floating longitudinal movement within constricted limits. As an alternative, one end of each rail can be welded to a foundation plate (not shown) while the opposite end rests on a plate as a bearing/support. If free-floating at both ends, raised protrusions 18 on the foundation plates will act as length stops.

Figure 2:
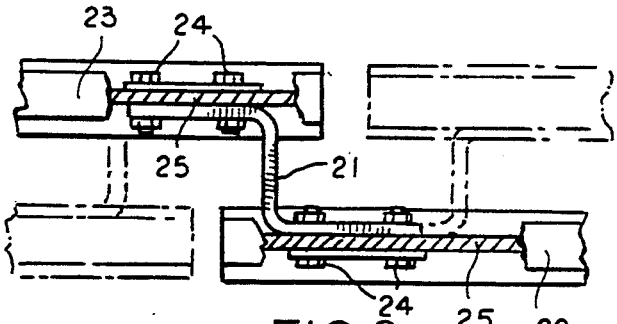
FIG. 2 is a partial top plan view partly in cross section of the overlapping portion of a pair of rails with a connector of the present invention therebetween.

As seen in FIG. 2, a double-gauge rail arrangement utilizing an extra parallel rail can be added where side sway is recognized as unusually severe due to topography, and a special "Z" bar connector 21 is suitably connected to each end of both the inner and outer rails 22 and 23 through suitable bolts 24 extending through openings in the rail webs 25 to provide better than double rail bend resistance since this is a truss-type arrangement. Such truss usage will greatly reduce sway-induced bending and hence greater economy in maintenance.

Figure 3:
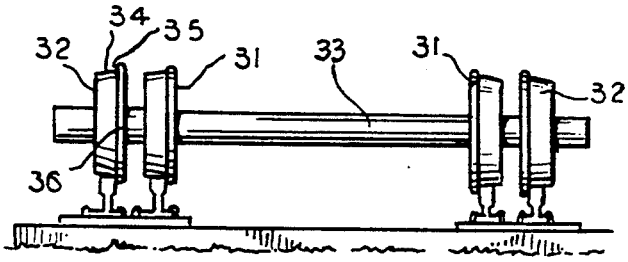
FIG. 3 is a side elevational view of modified railroad car wheels for the double-gauge track shown in cross section.

As seen in FIG. 3, the double rail systems of either FIGS. 1 or 2 can be used with pairs of wheels 31,31 and 32,32 on a single axle 33 rather than the single wheels on the opposite ends of a shaft of the prior art. The double wheel arrangement provides that at least one wheel of each pair is always in contact with the corresponding rail of the alternating rail system. Thus, the inner pairs of wheels 31 or the outer pairs of wheels 32 or, at times, both pairs are in contact with their respective rails. Otherwise the wheels have the same overall design as in previous embodiments of railroad rolling stock; i.e., each wheel is shaped with a conical diameter 34 blending with a radiused fillet 35 into an inner flange 36 so that the radius has a dynamic climb when swaying against the inside of the rail on that side of the tracks; resulting in a shift of the wheel (and the vehicle/car) back toward the center of the tracks. The flange 36 of each wheel 31 or 32 is positioned at the inner face of the wheel.

Figure 4:
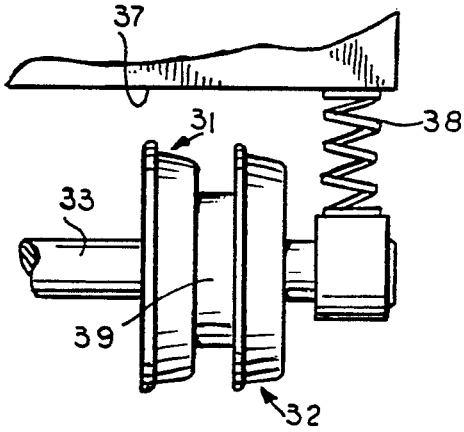
FIG. 4 is an enlarged partial side elevational view of a mounting system for the pair of wheels for a railroad car.
Figure 5:
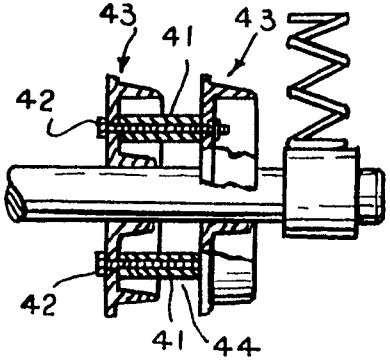
FIG. 5 is an enlarged partial side elevational view of an alternate mounting system for the pair of wheels similar to that shown in FIG. 4.

As seen in FIG. 4, the wheels 31,32 and axle 33 are supported on the car floor 37 by springs 38. The braking wheel 32 is that situated on the outer or normal gauge and a torque tube 39 connects the pair of wheels 31,32 for braking force on the inner gauge. Another means for effective braking is shown in FIG. 5 wherein spacer bushings 41 are bolted to the wheels 43 through the use of bolts 42 extending through their respective bushings, the bushings being evenly spaced around the wheel faces. Also, the gap 44 between the wheels 43 or 31,32 (FIG. 4) will effectively clear frogs 45 or counter rails 46 utilized at switching locations (see FIG. 7).

Figure 6:
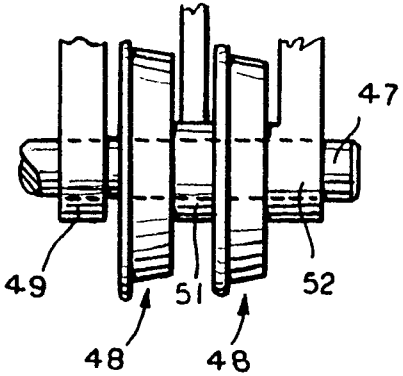
FIG. 6 is an enlarged partial side elevational view of a bearing system for the twin wheels of a railroad car.

Considering FIG. 6, the use of bearings on engines for axle support of the wheels 48 on the axle 47 are arranged and designed to fit between the wheels. Thus, a pair of wheels 48,48 have three bearings 49,51,52 located on the outer sides of the wheel pair and between the wheels. These bearings are suitably supported on the undercarriage of the engine so as to support the axle 47 extending between the pairs of wheels at the opposite sides of the engine or car (not shown).

Figure 8:
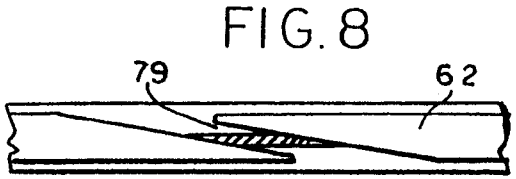
FIG. 8 is an enlarged partial top plan view of a notched rail used in a switch or crossing arrangement.
Figure 7:
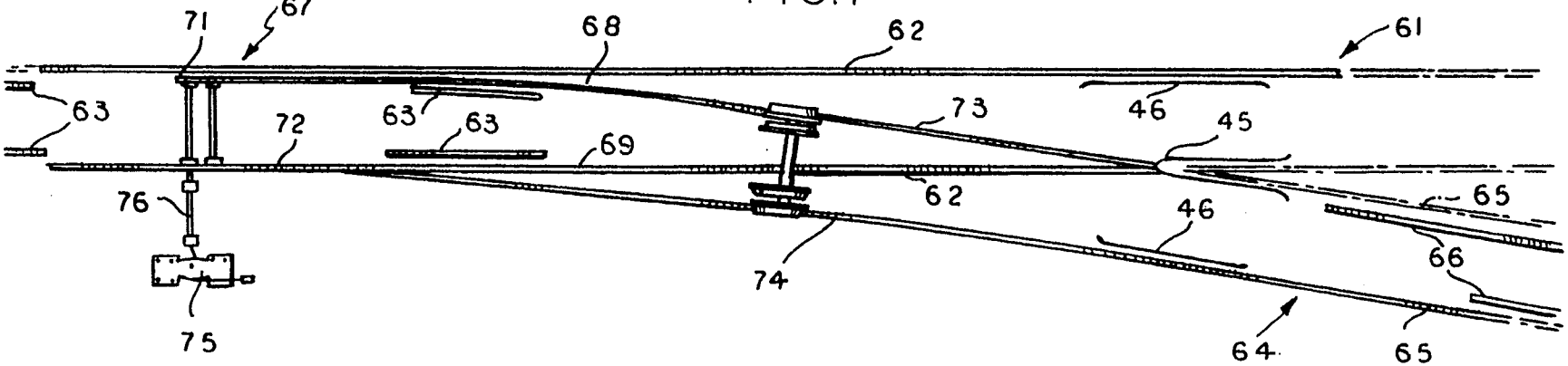
FIG. 7 is a top plan view of a switch arrangement for the double-gauge rail system of the present invention.

Now considering FIG. 7, a typical switching arrangement is shown with pairs of double gauge tracks 62,62 and 63,63 for a main line 61 and pairs of intersecting tracks 65,65 and 66,66 for a secondary line 64 intersecting the main line 61 at the switch assembly 67; wherein the assembly includes a switch mechanism for a pair of movable track sections consisting of a curved tongue 68 and a straight tongue 69 having switch points 71,72, and extending from a pair of curved track sections 73 and 74. A switch stand 75 and the connecting rod 76 extending between the switch stand and the switch proper completes the switch assembly. A frog 45 and counter rails 46 which are usually required at the "V" section of track in either a switch or cross-over can be eliminated in favor of inside wheel gauge rails 63,66 which overlap and may be continuous with the normal rail gauge sections to overlap the gaps required in the intersecting track sections; the main line inner rail 62 having a gap 79 as shown enlarged in FIG. 8 where the inner wheels have to intersect and cross the inner main line rail 62.

Considering the economics of the use of the double rail system to replace the conventional rail construction, the cost of welding thirty-nine foot rail sections per mile is estimated to be in the range of $80.00 per joint or approximately $21,700.00 per mile of rail. It is estimated that the cost of adding an extra pair of wheels for each axle totals approximately $3000.00 for each car manufactured. Therefore, the use of the double-gauge rail system will have the increased costs of the extra pair of wheels on each vehicle axle, the additional sets of rail sections for the inner gauge and the manpower to lay the inner and outer gauges of track sections, however the these costs are greatly outweighed by the substantially greater cost of welding, heat treatment, etc. for the welding operation and the manpower required therefor.

INDUSTRIAL APPLICABILITY

The present invention relates to the railroad industry in the arrangement of track for the engines and rail cars and in the wheel and axle arrangement for such engines and cars.

I claim:

1. A railroad track system having railroad track on a road bed with cross ties longitudinally spaced along the length thereof for supporting vehicle wheels, said railroad track comprising a double-gauge track system on said road bed having an outer track gauge and an inner track gauge of a lesser lateral dimension than the outer track gauge, the outer track gauge including a plurality of outer rail sections having opposite ends and the inner track gauge having a plurality of inner rail sections with opposite ends, said inner and outer rail sections alternating along an extended length of track with the ends of one rail section at least partially overlapping the ends of the adjacent rail sections, the inner and outer rail sections adapted to receive pairs of vehicle wheels on each end of an axle to continuously contact either the inner or outer rail sections to provide a smooth ride.

2. A railroad track system as set forth in claim 1, in which at least one end of each rail section for both said inner and outer track gauges is anchored on said cross ties in the road bed for the railroad track.

3. A railroad track system as set forth in claim 1, wherein the double-gauge track utilizes standard cut rail sections of alternating gauge in rail switch turnouts and cross-overs.

4. A railroad track system having railroad track on a road bed with cross ties longitudinally spaced along the length thereof for supporting vehicle wheels, said railroad track comprising a double-gauge track system on said road bed having an outer track gauge and an inner track gauge of a lesser lateral dimension than the outer track gauge, the outer track gauge including a plurality of rail sections provided with opposite ends and the inner track gauge including a plurality of inner rail sections with opposite ends, said inner and outer rail sections at least partially overlapping the adjacent ends of the other rail sections, the outer and inner rail sections adapted to receive pairs of vehicle wheels on each end of an axle to continuously contact either the inner or outer rail sections to provide a smooth ride, said overlapping ends of said inner and outer rail sections being connected by "Z" bars which are bolted through the webs of both the inner and outer rail sections adjacent their ends to allow for axial movement of each rail section due to thermal expansion and contraction.

5. A railroad track system having railroad track on a road bed with cross ties longitudinally spaced along the length thereof for supporting vehicle wheels, said railroad track comprising a double-gauge track system on said road bed having an outer track gauge and an inner track gauge of a lesser lateral dimension than the outer track gauge, said outer track gauge including a plurality of outer rail sections with opposite ends and the inner track gauge including a plurality of inner rail sections with opposite ends, said inner and outer rail section ends at least partially overlapping the ends of said outer rail sections, the outer and inner rail sections adapted to receive pairs of vehicle wheels on each end of an axle to continuously contact either the inner or outer rail sections to provide a smooth ride, and foundation plates for the rail sections which are suitably secured to the cross ties and one end of each rail section is welded to a foundation plate; the opposite end of each rail section resting on another spaced foundation plate as a bearing/support.

6. A railroad track system having railroad track on a road bed with cross ties longitudinally spaced along the length thereof for supporting vehicle wheels, said railroad track comprising a double-gauge track system having an outer track gauge and an inner track gauge of a lesser lateral dimension than the outer track gauge, the outer track gauge including a plurality of rail sections provided with opposite ends and the inner track gauge including a plurality of inner rail sections with opposite ends, said inner and outer rail section ends at least partially overlapping the adjacent ends of the alternating other rail sections, the outer and inner rail sections adapted to receive pairs of vehicle wheels on each end of an axle to continuously contact either the inner or outer rail sections to provide a smooth ride, each said rail section being free-floating at both ends thereof, and a foundation plate for each rail end including a raised protrusion acting as a length stop for that rail.

7. In combination, a double-gauge rail system and wheel arrangement for railroad cars and engines, wherein the double-gauge rail system includes pairs of substantially parallel outer gauge rail sections and pairs of substantially parallel alternating inner gauge rail sections of a second smaller rail gauge, said inner and outer gauge rail sections having opposite ends and alternating over the extent of the rail system with the ends of adjacent rail sections at least partially overlapping, and each vehicle car having at least one axle with opposite ends adjacent each end of said car, and a pair of wheels for each end of each vehicle axle, wherein at least one wheel of each pair of wheels is always in contact with one of the rail sections.

8. The combination as set forth in claim 7, in which said pair of vehicle wheels are separated on the axle but joined by a torque tube encompassing said axle so as to impart braking from the outer wheel to the inner wheel.

9. The combination as set forth in claim 7, wherein at least one wheel of each pair of wheels is in contact with one of alternating rail sections at all times to promote a smooth ride for the vehicle car.

10. The combination as set forth in claim 7, wherein said pairs of wheels on each axle have inner flanges contacting the inner surfaces of the rails.

11. The combination as set forth in claim 7, wherein each pair of wheels on each axle are supported from the vehicle car by a series of bearings on the axle, one bearing being located between a pair of wheels and two bearings being located on the opposite sides of the pair of wheels.

12. In combination, a double-gauge rail system and wheel arrangement for railroad cars and engines, wherein the double-gauge rail system includes pairs of substantially parallel outer gauge rail sections and pairs of substantially parallel alternating inner gauge rail sections of a second smaller rail gauge, said inner and outer gauge rail sections having opposite ends and alternating over the extent of the rail system with the ends of adjacent rail sections at least partially overlapping, and each vehicle car having at least one axle with opposite ends adjacent each end of the car and a pair of wheels having wheel faces for each end of each vehicle axle, wherein at least one of each pair of wheels is always in contact with one of the rail sections, and wherein the inner and outer wheels at an end of each axle are joined together by spacer bushings and bolts extending through the bushings and wheels and evenly spaced around the wheel face.

13. In combination a double-gauge rail system and wheel arrangement for railroad cars and engines, wherein said double-gauge rail system includes pairs of substantially parallel outer gauge rail sections and pairs of substantially parallel inner rail sections of a second smaller rail gauge, said pairs of inner and outer gauge rail sections having opposite ends and alternating over the extent of the rail system with the ends of adjacent rail sections at least partially overlapping, and a "Z" bracket joining the ends of the inner and outer gauge rail sections to provide a truss-type arrangement, and each vehicle car having at least one axle with opposite ends adjacent each end of said car and a pair of wheels for each end of each vehicle axle, wherein at least one of each pair of wheel is always in contact with one of the rail sections.

14. The combination as set forth in claim 13, wherein the "Z" connector is bolted through the webs of both rail sections.

15. A structure for supporting vehicle wheels at a rail joint between a pair of rail sections of a first gauge having ends in longitudinal alignment and a gap between the adjacent rail ends, said rail sections supporting a first wheel at a predetermined elevation, and means for supporting a second wheel paired with and spaced from the first wheel on a common axle in the region overlapping the gap and at substantially the same elevation, comprising at least one alternating rail section of a second gauge laterally spaced from and paralleling said first mentioned rail sections and having an end at least partially overlapping the adjacent ends of the first mentioned rail sections across said gap so that at least one wheel of each pair is in contact with corresponding rail sections at all times.

* * * * *